US007174758B2

(12) United States Patent
Täuber et al.

(10) Patent No.: US 7,174,758 B2
(45) Date of Patent: Feb. 13, 2007

(54) DEVICE FOR MEASURING THE ROLL GAP BETWEEN THE WORKING ROLLERS OF A COLD OR WARM ROLLING STAND

(75) Inventors: Dirk Täuber, Hilchenbach (DE); Dieter Daub, Hilchenbach (DE); Hartmut Pawelski, Ratingen (DE); Josef Zeppenfeld, Olpe (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 293 days.

(21) Appl. No.: 10/498,653

(22) PCT Filed: Nov. 20, 2002

(86) PCT No.: PCT/EP02/12976

§ 371 (c)(1),
(2), (4) Date: Jun. 10, 2004

(87) PCT Pub. No.: WO03/053604

PCT Pub. Date: Jul. 3, 2003

(65) Prior Publication Data

US 2005/0066698 A1 Mar. 31, 2005

(30) Foreign Application Priority Data

Dec. 12, 2001 (DE) ..... 101 61 094
Jan. 24, 2002 (DE) ..... 102 02 526

(51) Int. Cl.
*B21B 37/58* (2006.01)
*B21B 29/00* (2006.01)

(52) U.S. Cl. ..... 72/10.7; 72/10.6; 72/14.5; 72/31.08; 72/241.8

(58) Field of Classification Search ..... 72/10.1, 72/10.4, 10.6, 10.7, 13.4, 14.4, 14.5, 31.08, 72/241.8
See application file for complete search history.

(56) References Cited

U.S. PATENT DOCUMENTS 3,353,385 A * 11/1967 Karl et al. ..... 72/10.7

(Continued)

FOREIGN PATENT DOCUMENTS

DE 1602195 3/1970

(Continued)

OTHER PUBLICATIONS

Patent Abstracts of Japan, vol. 007, No. 068 (M-201), Mar. 19, 1983 & JP 57 209710 A (Sumitomo Kinzoku Kogyo KK), Dec. 23, 1982.

(Continued)

*Primary Examiner*—Ed Tolan
(74) *Attorney, Agent, or Firm*—Friedrich Kueffner

(57) ABSTRACT

A device for measuring the roll gap (7) between the working rollers (1*a:* 1*b*) of a cold or warm rolling stand for rolling out narrow or wide strips of metal, especially NE metal strips, by means of roll gap sensors (6) whose signals are transmitted to the servo-valves of the compressed oil control as a roll gap setpoint value for the piston cylinder units influencing said roll gap (7), and used to provide a roller gap measurement which is also suitable for such cases involving the lateral progression of said strip. In order to achieve said aim, the position or travel sensor (6) is provided in at least one bending cylinder (5*a*;5*b*) for the working cylinder (1*a,* 1*b*) for indirect reference measurement of the roll gap via the positively or negatively acting bending cylinders (5*a;* 5*b*).

7 Claims, 4 Drawing Sheets

U.S. PATENT DOCUMENTS 3,733,875 A * 5/1973 Steimer ..... 72/237
4,343,167 A * 8/1982 Hasegawa et al. ..... 72/10.7

FOREIGN PATENT DOCUMENTS

| | | | |
|---|---|---|---|
| DE | 1602033 | | 4/1970 |
| EP | 0698428 | | 2/1996 |
| JP | 56-144812 | * | 11/1981 |
| JP | 57-137012 | * | 8/1982 |
| JP | 58-199610 | * | 11/1983 |

OTHER PUBLICATIONS

Patent Abstracts of Japan, vol. 011, No. 028 (M-557), Jan. 27, 1987 & JP 61 199506 A (Ishikawajima Harima Ind Co Ltd), Sep. 4, 1986.
Patent Abstracts of Japan, vol. 006, No. 196 (M-161), Oct. 5, 1982 & JP 57 103723 A (Kawasaki Steel Corp), Jun. 28, 1982.
Patent Abstracts of Japan, vol. 011, No. 140 (M-586), May 8, 1987 & JP 61 276708 A (Sumitomo Metal Ind Ltd), Dec. 6, 1986.

* cited by examiner

DEVICE FOR MEASURING THE ROLL GAP BETWEEN THE WORKING ROLLERS OF A COLD OR WARM ROLLING STAND

This application is a 35 USC 371 of PCT/EP02/12976 filed Nov. 20, 2002.

BACKGROUND OF THE INVENTION

1. Field of the Invention

The invention concerns a device for measuring the roll gap between the work rolls of a cold or hot rolling stand for rolling out narrow or wide metal strip, especially nonferrous metal strip, by means of roll gap sensors in the form of measuring probes, displacement sensors, electrohydraulic converters, magnetostrictive transducers, and the like, whose signal can be transmitted as a roll gap set point to the servovalves of the hydraulic oil control for the piston-cylinder units that control the roll gap.

2. Description of the Related Art

The roll gap has previously been measured by measuring tongs between the work rolls (DE-OS 25 03 130) on stepped diameters next to the roll barrels on the drive side and on the tending side of the rolling stand. This arrangement near the edge of the strip often causes damage to the device due to strip progression or strip breakage. A disadvantage of this type of arrangement is the large amount of maintenance work, and swinging the device into the maintenance position interferes with the designing of other necessary products.

SUMMARY OF THE INVENTION

Due to the phenomenon that the bending hysteresis of the work rolls leads to the development of differences in the roll gap from the drive side to the tending side, these differences cannot be detected by the sensor of the hydraulic adjustment system. In the case of narrow soft metal strip, this causes considerable strip progression during the threading of the strip in and out. Therefore, the devices for measuring the roll gap also serve to automatically control the inclination by means of the adjustment system or the displacement sensors on the backup roll chocks, so that direct roll gap measurement is possible. In this regard, the inclination of the roll gap cannot be adjusted with sufficient precision due to the fact that the measurement occurs too far from the roll gap. Although previous devices nevertheless work accurately, they are complicated and therefore expensive and easily damaged.

The objective of the invention is to develop a device for roll gap measurement that is suitable even when lateral strip progression occurs and at the same time is designed in such a way that it is protected and requires little maintenance.

In accordance with the invention, this objective is achieved by installing the position sensor or displacement sensor in at least one bending cylinder for the work rolls for indirect reference measurement of the roll gap via the positively or negatively acting bending cylinders. This results in displacement measurement near the roll gap with the advantage of indirect detection of the change in the roll gap. Furthermore, the roll gap-measuring device is arranged not only near the roll gap, but also in a way that is fully protected inside the bending cylinder. This arrangement also leads to low maintenance work. Analysis of measured values shows that installation of the displacement sensor in the bending cylinder represents the roll gap with sufficient accuracy for automatic control against lateral strip progression. It is even possible to achieve resolutions of less than 10 μm. The automatic control of the measured inclination of the strip is accomplished via the adjustment system and/or different bending forces in the piston-cylinder units.

In accordance with an alternative method, the related objective of carrying out the roll gap measurement at low rolling force is achieved by installing the position or displacement sensor at least between the bending blocks or the work roll chocks or between the stationary cylinder block and a moving part for indirect reference measurement of the roll gap. This method can be used with modular construction or in the frictionally locked work roll bending system in the bending cylinder of the negatively or positively acting bending cylinders.

In this regard, it is also advantageous to be able to use the reference values for the roll gap to control the position of the bending cylinders.

Further advantages are obtained if the reference values for the roll gap can be sent to the hydraulic roll adjustment system, and the roll gap can be automatically controlled by the roll adjustment system and/or by the bending of the work rolls.

In accordance with additional features of the invention, the accuracy of the roll gap automatic control can be increased by assigning a position or displacement sensor to each bending cylinder according to the number of bending cylinders in a rolling stand.

In accordance with additional features of the invention, a practical embodiment can be designed in such a way that the position or displacement sensor penetrates a cylinder liner, on whose end face a magnet for the sensor rod of the magnetostrictive transducer is mounted in a centric cavity of the piston for the bending cylinder, and that the sensor rod, which penetrates the piston rod of the bending cylinder, runs in an axial central bore of the piston rod, which ends at a vent hole.

In accordance with additional features of the invention, a position or displacement sensor, which is rigidly mounted in a bending block, can be adjusted in a guide tube in a cylinder block for the bending cylinders.

In addition, it is advantageous for the guide tube to be rigidly mounted in a bending block and to be slidingly supported in the opposing bending block.

In this regard, another embodiment provides that the guide tube is slidingly supported in a guide bush in an opposing bending block.

Embodiments of the invention are illustrated in the drawings and are explained in greater detail below.

DETAILED DESCRIPTION OF THE INVENTION

The work rolls 1*a* and 1*b* (FIG. 1) are shown in partial cross section and are each reinforced by a backup roll 2. The work roll chocks 3*a*, 3*b* are supported in the roll housings in the usual way.

Figure 1:
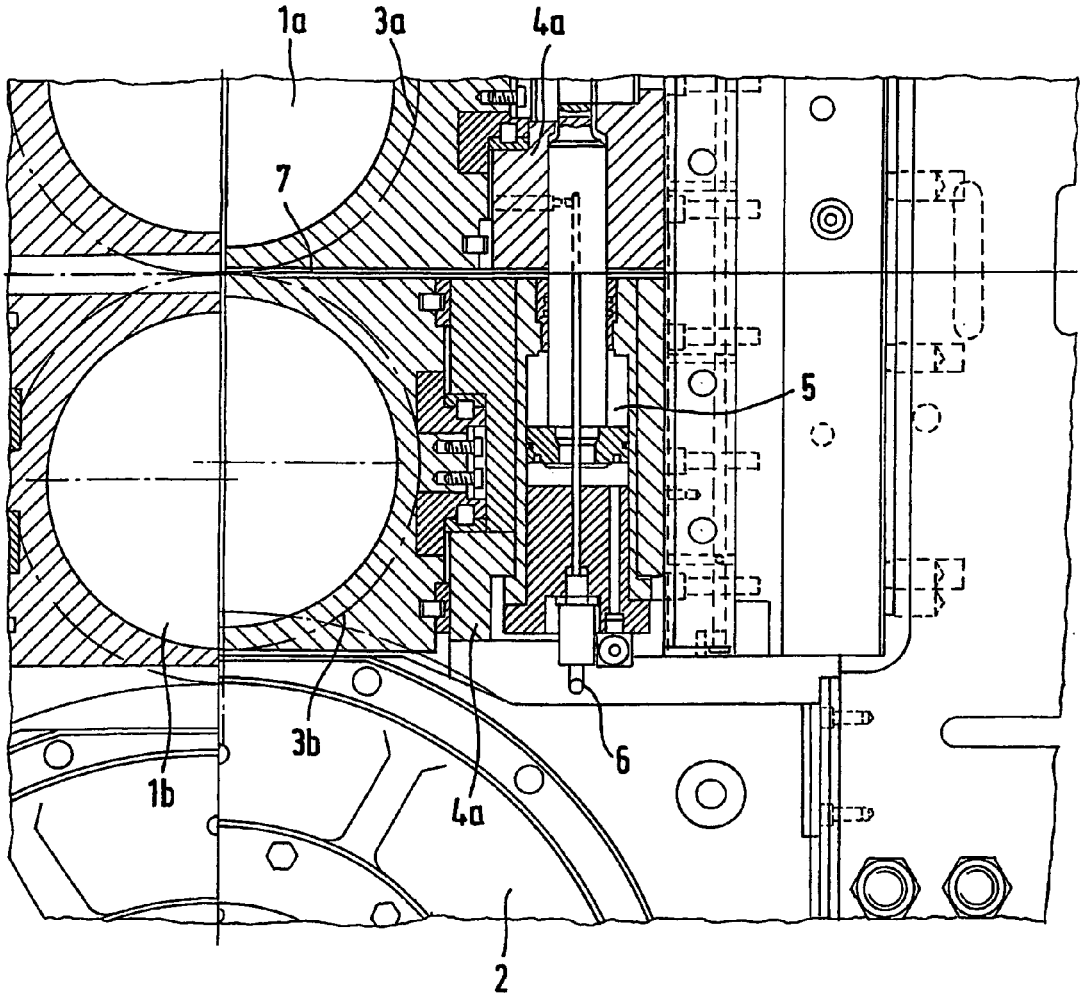
FIG. 1 shows a partial cross section through the work rolls of a hot or cold rolling stand with an axial section through a bending cylinder.
Figure 2:
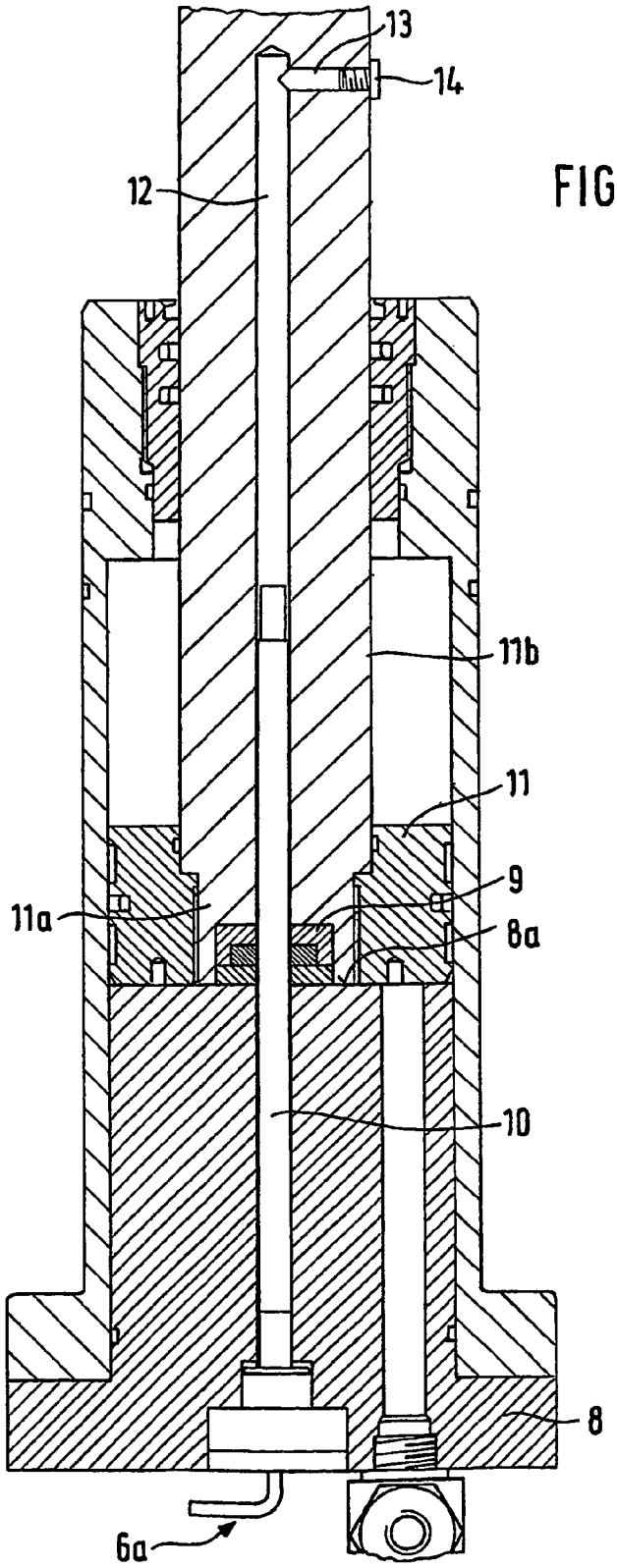
FIG. 2 shows an axial section through the bending cylinder with a position sensor in its interior.

The work rolls 1*a* and 1*b* are additionally held in bending blocks 4*a* and 4*b*, so that they can be moved perpendicularly to the roll gap 7. The bending blocks 4*a*, 4*b* are mounted on the roll housings (not shown) of the rolling stand. The bending cylinders 5*a*, 5*b* are mounted in the bending blocks 4*a*, 4*b*. A position or displacement sensor 6 for the reference measurement of the roll gap is installed in each bending cylinder 5*a*, 5*b* and integrated in the bending cylinder 5*a*, 5*b*. The illustrated position or displacement sensor 6 is designed as a magnetostrictive sensor (FIGS. 1 and 2). An automatic control system or control circuit is constructed from the measured values of the position or displacement sensor 6.

The measured automatic control values effect an exact adjustment of the roll gap 7 to achieve optimum threading into and out of the closed roll gap 7 and optimum rolling of metal strip (made of steel or nonferrous materials) with the desired flatness and the required profile.

The magnetostrictive position or displacement sensor 6 is shown enlarged in FIG. 2. The position or displacement sensor 6 penetrates a cylinder liner 8, on whose end face 8*a* a magnet 9 for the sensor rod 10 of the magnetostrictive transducer 6*a* is mounted in a centric cavity 11*a* of the piston 11. The piston rod 11*b*, which supports the piston 11, has an axial central bore 12, in which the sensor rod 10 is mounted. The central bore 12 ends at a vent hole 13 with a screw plug 14.

Figure 3:
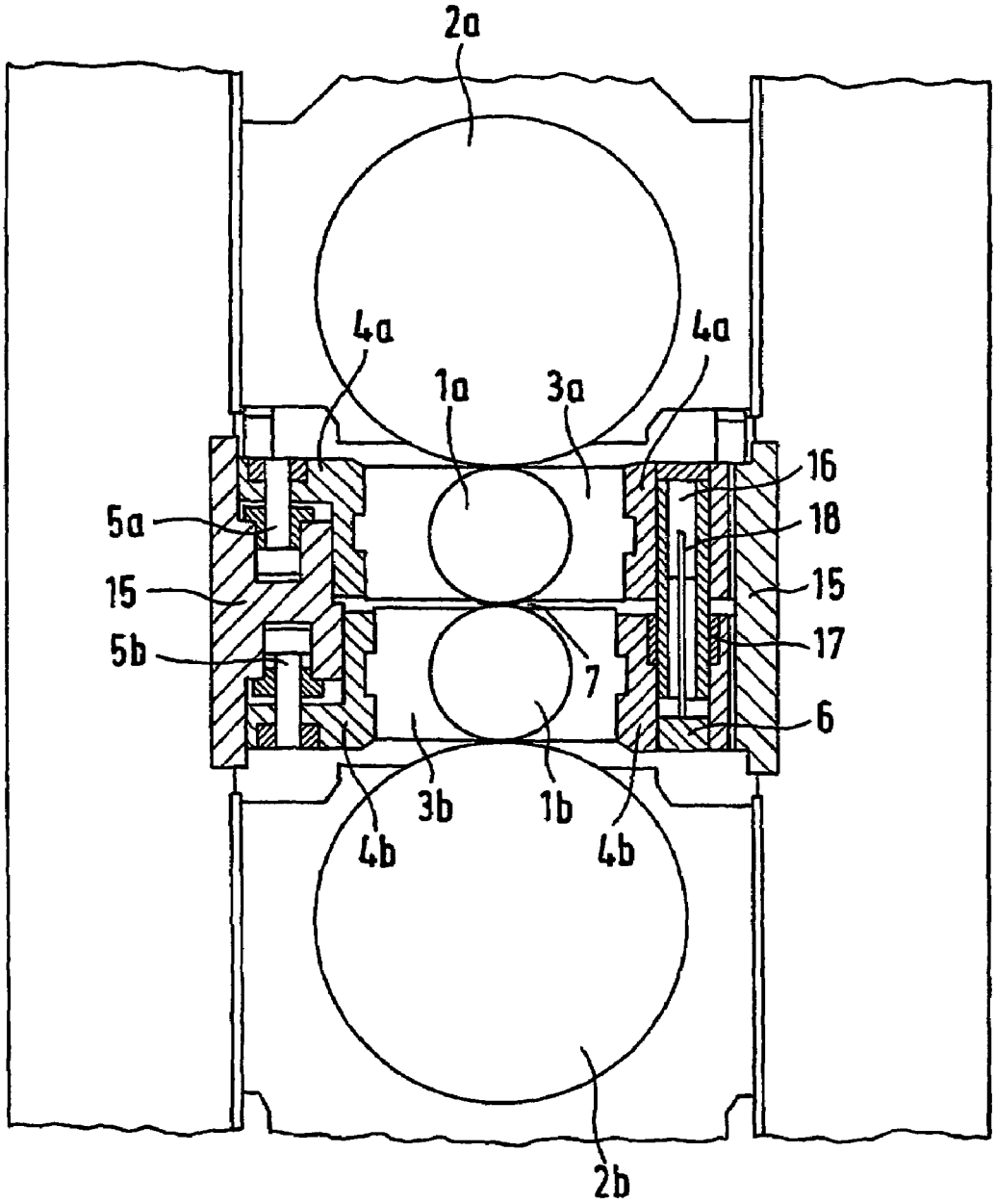
FIG. 3 shows a section through an alternative embodiment between the bending blocks or the work roll chocks.

In accordance with FIG. 3, a guide tube 16 is installed in each cylinder block close to the roll gap 7. In the bending block 4*a*, the guide tube 16 is supported by a guide bush 17 on the opposite side in bending block 4*b*, and the position or displacement sensor 6 is guided and supported by a guide rod 18.

Figure 4:
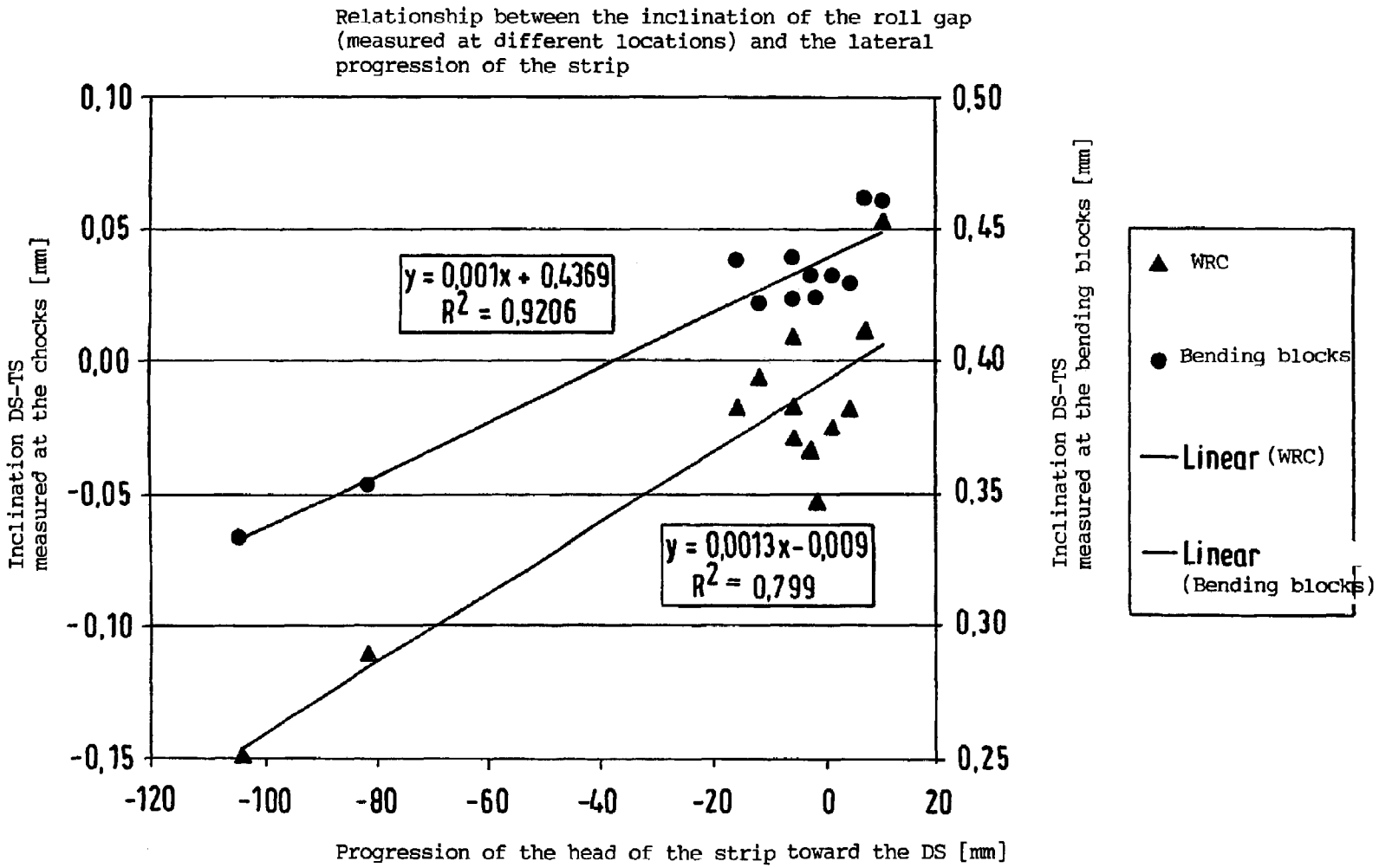
FIG. 4 shows a graph of the inclination of the strip relative to the progression of the head of the strip.

The graph in FIG. 4 shows the relationship between the inclination of the roll gap 7 (measured at different locations) and the lateral progression of the rolled strip (made of steel or softer nonferrous materials). A favorable value of the degree of certainty $R^2$ of the linear regression is a value close to "1" and is useful as a controlled value. In the lower region, $R^2$ is smaller than in the upper region and is less suitable as a controlled value. It follows from these relationships that automatic control of the inclination of the rolled strip by measurement at the bending blocks 4*a*, 4*b* can greatly minimize the undesirable lateral progression of the strip.

LIST OF REFERENCE NUMBERS

1*a* work roll
1*b* work roll
2*a* backup roll
2*b* backup roll
3*a* work roll chock
3*b* work roll chock
4*a* bending block
4*b* bending block
5*a* bending cylinder
5*b* bending cylinder
6 position or displacement sensor
6*a* magnetostrictive transducer
7 roll gap
8 cylinder liner
9 magnet
10 sensor rod
11 piston
11*a* centric cavity
11*b* piston rod
12 axial central bore
13 vent hole
14 screw plug
15 cylinder block
16 guide tube
17 guide bush
18 guide rod

The invention claimed is:

1. Device for measuring a roll gap (7) between work rolls (1*a*; 1*b*) of a cold or hot rolling stand for rolling out narrow or wide metal strip by means of roll gap sensors in the form of measuring probes, displacement sensors (6), electrohydraulic converters, magnetostrictive transducers (8*a*) whose signal can be transmitted as a roll gap set point to servovalves of a hydraulic oil control for piston-cylinder units that control the roll gap (7), wherein the position or displacement sensor (6) is installed close to the roll gap (7) in at least one bending cylinder (5*a*; 5*b*) for the work rolls (1*a*, 1*b*) for indirect reference measurement of the roll gap via the positively or negatively acting bending cylinders (5*a*; 5*b*) to counteract lateral strip progression and wherein the position or displacement sensor (6) penetrates a cylinder liner (8), on whose end face a magnet (9) for a sensor rod (10) of the magnetostrictive transducer (8*a*) is mounted in a centric cavity (11*a*) of the piston (11) for the bending cylinder (5), and the sensor rod (10), which penetrates the piston rod (11*b*) of the bending cylinder (5), runs in an axial central bore (12) of the piston rod (11*b*), which ends at a vent hole (13).

2. Device in accordance with claim 1, wherein the reference values for the roll gap can be used to control the position of the bending cylinders (5*a*; 5*b*).

3. Device in accordance with claim 1, wherein the reference values for the roll gap can be sent to the hydraulic roll adjustment system, and the roll gap (7) can be automatically controlled by the roll adjustment system and/or by the bending of the work rolls (1*a*, 1*b*).

4. Device in accordance with claim 1, wherein a position or displacement sensor (6) is assigned to each bending cylinder (5*a*; 5*b*) according to the number of bending cylinders (5*a*; 5*b*) in a rolling stand.

5. Device in accordance with claim 1, wherein a position or displacement sensor (6), which is rigidly mounted in a bending block (4*a*; 4*b*), can be adjusted in a guide tube (16) in a cylinder block (15) for the at least in bending cylinder (5*a*; 5*b*).

6. Device in accordance with claim 1, wherein a guide tube (16) is rigidly mounted in a bending block (4*a*; 4*b*) and slidingly supported in the opposing bending block (4*a*; 4*b*).

7. Device in accordance with claim 6, wherein the guide tube (16) is slidingly supported in a guide bush (17) in an opposing bending block (4*a*; 4*b*).

* * * * *